United States Patent [19]

Wehr

[11] 4,215,496

[45] Aug. 5, 1980

[54] VEHICLE BUMPER

[76] Inventor: Thomas L. Wehr, R.R. #1, Box 317, Fairland, Ind. 46126

[21] Appl. No.: 959,509

[22] Filed: Nov. 13, 1978

[51] Int. Cl.[3] ..... E02F 3/76

[52] U.S. Cl. ..... 37/117.5; 172/801; 293/106; 293/114; 254/395; 37/42 R

[58] Field of Search ..... 37/41, 117.5, DIG. 3, 37/42; 254/166, 186 R, 189, 190 R, 191, 192, 193, 194, 195, 196, DIG. 9; 214/DIG. 5; 293/106, 114; 172/801-809

[56] References Cited

U.S. PATENT DOCUMENTS

| | | | |
|---|---|---|---|
| 2,446,220 | 8/1948 | Erdahl | 254/193 X |
| 3,338,614 | 8/1967 | Sadler, Jr. | 293/106 |
| 3,447,826 | 6/1969 | Gostomski | 293/114 |
| 3,614,136 | 10/1971 | Dent | 293/106 X |
| 3,720,399 | 3/1973 | Bozeman, Jr. | 254/192 X |
| 3,769,724 | 11/1973 | Morgaard | 37/41 |
| 3,828,449 | 8/1974 | Miceli | 37/41 |
| 3,976,210 | 8/1976 | Allen | 254/193 X |
| 4,013,270 | 3/1977 | Laky et al. | 254/193 X |

*Primary Examiner*—Eugene H. Eickholt
*Attorney, Agent, or Firm*—Jenkins, Coffey, Hyland, Badger & Conard

[57] ABSTRACT

A front bumper for a two- or four-wheel drive utility vehicle permits simultaneous mounting of a power winch and snow removal blade assembly, such that both the winch and snow blade can be used, and remain attached to the vehicle at the same time. The snow removal blade includes a riser portion providing additional clearance between the blade mounting portion of the front bumper and ground beneath the vehicle when the snow removal blade assembly is removed from the vehicle.

17 Claims, 5 Drawing Figures

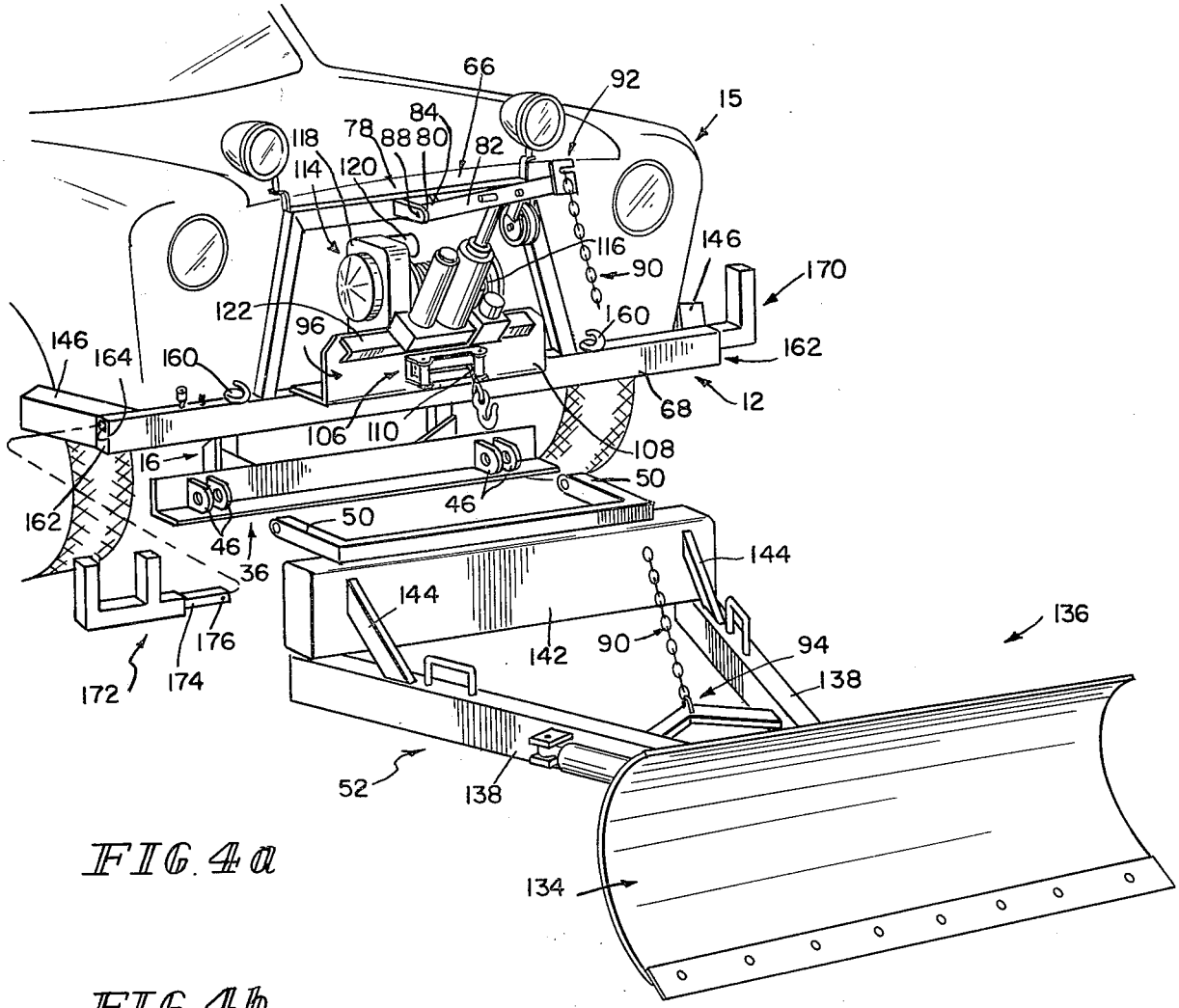
FIG. 4a
FIG 4b
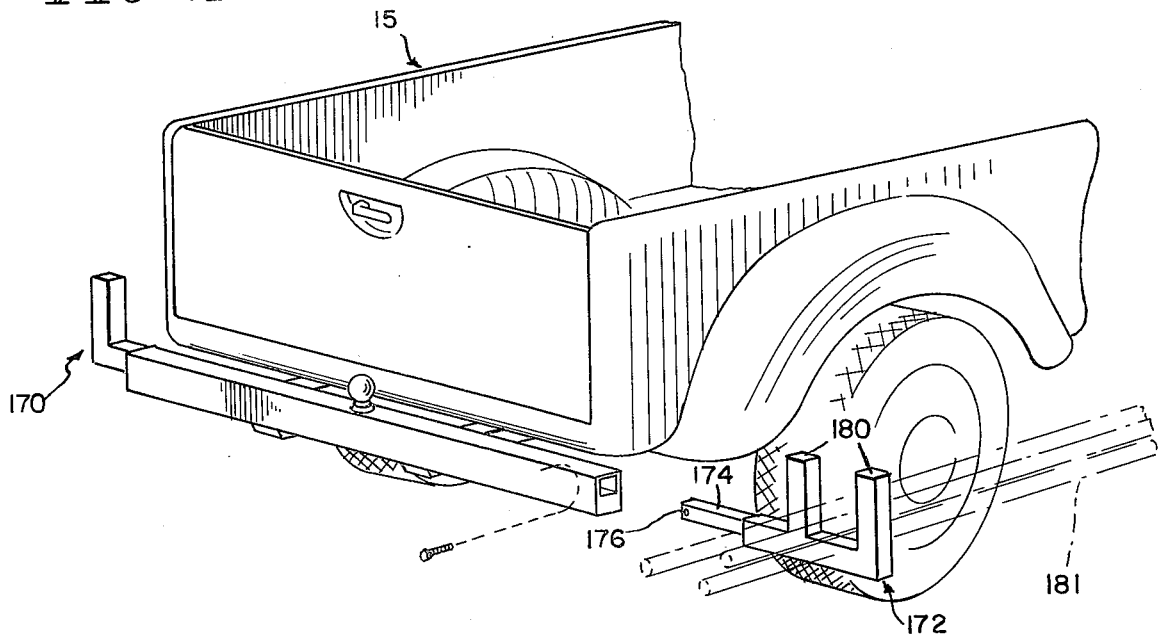

VEHICLE BUMPER

This invention relates to vehicle accessories, and particularly to a form of vehicle front bumper incorporating means for concurrently attaching to the vehicle a snow-removal blade and a power winch.

Two- and four-wheel drive utility vehicles are currently enjoying increased popularity. This popularity is attributable, at least partly, to the severity of recent winters in the Northeast and Midwest. Owners of such utility vehicles are always searching for accessories and attachments which permit their vehicles to be useful in a wider variety of applications. Two of the more popular accessories for such vehicles in recent years have been power winches and snow removal blades. Various proposals have been made for systems for mounting power winches on the front bumpers of utility vehicles. Devices according to such proposals are currently in use. Proposals have also been made for apparatus for attaching snow removal blades to the front bumpers of utility vehicles. Devices according to some of such proposals are also currently in use.

However, it has been a weakness of the art that no system has been devised for simultaneously mounting a winch and snow blade from a vehicle front bumper, such that both the winch and the snow blade could be used, or at least remain attached to the vehicle, simultaneously. It is extremely desirable to provide systems whereby such accessories remain attached to the utility vehicle, so that the full flexibility of the vehicle is achieved without the operator having to remove and replace various accessories as they are required.

In accordance with the present invention, a combination mounting is provided for a winch and a grading-type, e.g., snow removal, blade. The combination mounting provides excellent flexibility, permitting use of either the winch or the blade, or both simultaneously, with the blade in either the "up" or "down" position.

According to the invention, a combination for mounting a winch and snow blade from a vehicle comprises first means including an elongated member for supporting the winch, and means for mounting the elongated member to extend generally transversely across the front of the vehicle body. Second means extend rearwardly and downwardly from the first means beneath the vehicle undercarriage. Third means are provided at the distal end of the second means for movably and selectively removably a snow blade assembly. A lift arm is mounted on the first means for the snow blade assembly. A support frame means is movably mounted on the third means for movably supporting the snow blade.

Illustratively, the support frame means includes a frame having a generally A-shaped plan view configuration and a somewhat L- or Z-shaped side elevational configuration. The L- or Z-shaped side elevational configuration is achieved by riser means between the third means beneath the vehicle forward undercarriage and arm means supporting the blade itself. This is desirable for ground clearance when the snow blade assembly is removed, e.g., during the summer months.

According to one illustrated embodiment, the elongated first member is formed to provide a tube closed at its ends to provide a storage tank for a fluid, such as air, in the first member. The air is placed in the tube under pressure to provide a source of emergency compressed air.

Illustratively, the lift arm means includes a portion pivotally mounted above the elongated member and extending forward from the vehicle front end. Means, such as a chain, connects the lift arm movable portion to the snow blade assembly. A hydraulic piston and cylinder is connected at one end to the lift arm movable portion, and at the other end to the elongated member. Actuation of the piston and cylinder pivots the snow blade assembly upon the third means upwardly and downwardly between storage and use positions.

Illustratively, the elongated member includes a winch mounting bracket. The winch mounting bracket includes means providing a roller fairlead for the winch cable.

In the illustrated embodiment, the first means further includes a generally quadrilateral combination vehicle body front end guard, winch guard and auxiliary lamp mounting bracket.

Further illustratively, the elongated member includes an attachment point, such as a forwardly opening hook, and the apparatus further includes a chock for a front wheel of the vehicle, the chock being attached to the attachment point by flexible means, such as chain. The chock is specially designed so that it may be used to stop the vehicle against forward movement when the winch is being used.

Further according to the invention, one of an upper, forwardy projecting portion of the combination, such as the lift arm, is equipped with a snatch block adapted to support the winch cable to provide additional vertical clearance between the winch cable and the vertically upper edge of the snow blade to prevent interference between the winch cable and snow blade apparatus.

Additionally, according to the invention, the elongated member includes opposite ends and means defining at the opposite ends, sockets for receiving the tongues of accessories, such as a vehicle corner protector or side carrier. Locking means are provided for locking the tongue to the accessory into the socket. The locking means illustratively includes a threaded passageway in the elongated member end and a mating threaded passageway in the tongue, and a threaded shaft received in the passageways to lock the tongue in the socket.

The invention may best be understood by referring to the following description and accompanying drawings which illustrate the invention. In the drawings.

FIGS. 4*a–b* are a fragmentary front perspective view of the apparatus installed on a vehicle, and a fragmentary rear perspective view of the vehicle, respectively, showing two accessories useful with the apparatus.

Figure 1:
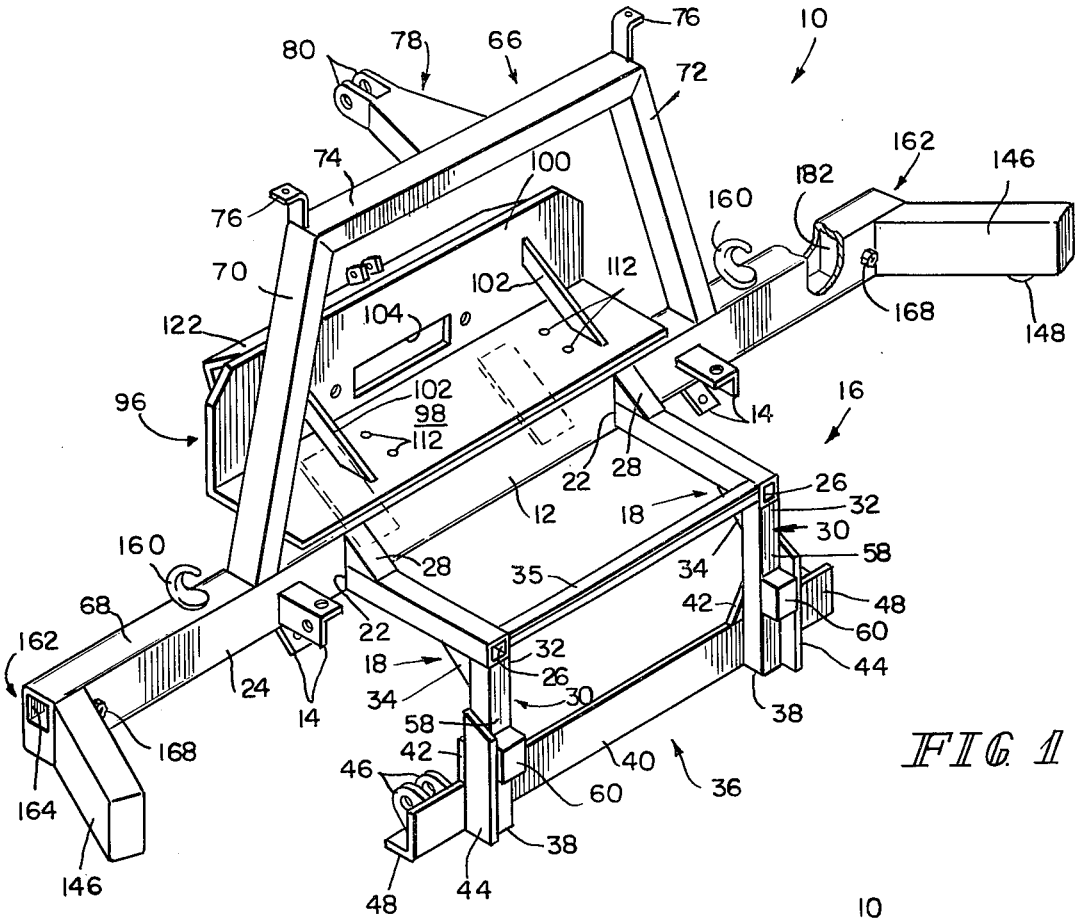
FIG. 1 is a partly broken away, rear perspective view of a combination mounting for a power winch and snow-removal blade according to the present invention.
Figure 2:
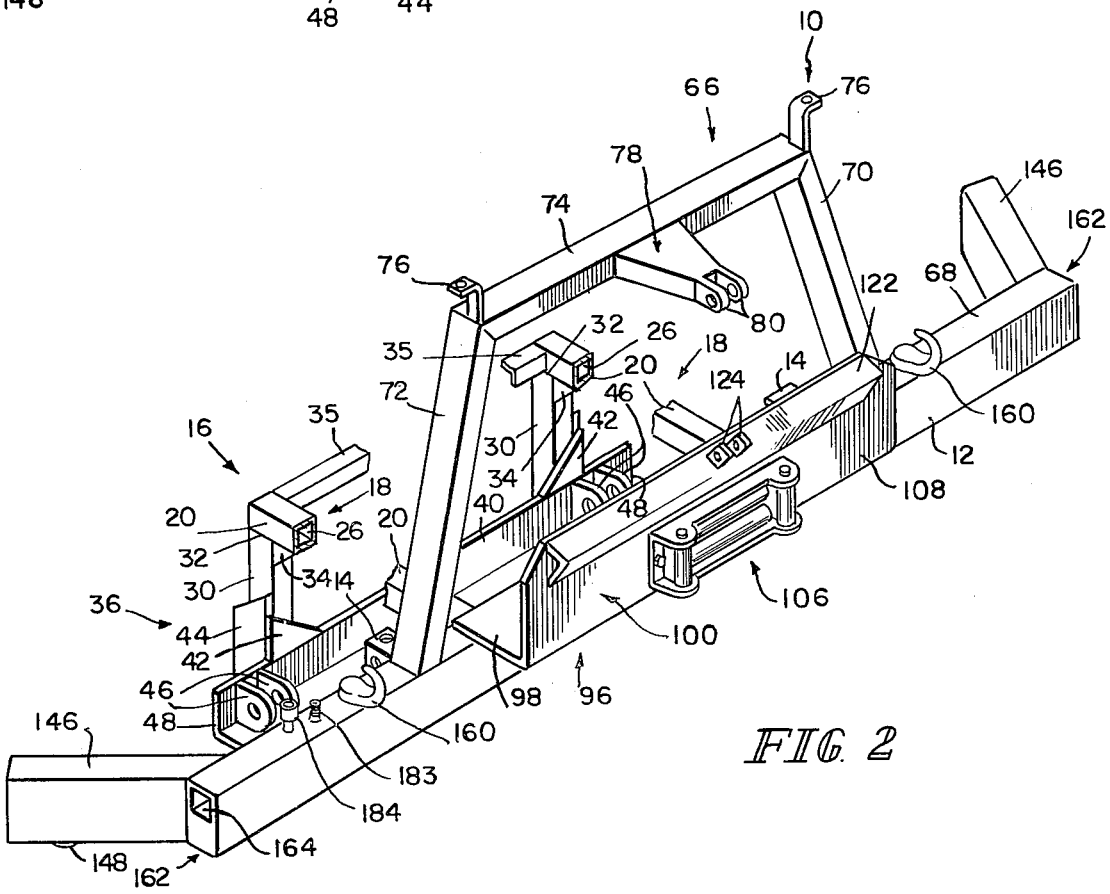
FIG. 2 is a partly fragmentary front perspective view of the mounting apparatus of FIG. 1.

Referring now specifically to FIGS. 1–2, the combination mounting 10 for a winch and snow removal blade includes an elongated member 12, and means including mounting brackets 14, projecting rearwardly from member 12 for mounting it on a vehicle. The member 12 is designed to extend generally transversely across the front of the vehicle body 15 (FIGS. 3*a*, 4) in place of the front bumper of the vehicle. Mounting 10 further includes means 16 (FIGS. 1–2) extending generally longitudinally of the vehicle and downwardly from the elongated member 12 beneath the forward undercarriage of the vehicle. As illustrated, the means 16 comprises two generally L-shaped bracket assemblies 18, each having a first, generally horizontally extending leg 20 welded at its forward end 22 to a rearwardly facing surface 24 of the first member 12, and a rearward end 26. The forward end 22 junctions with surface 24 are reinforced by gussets 28. Bracket assemblies 18 further include generally downwardly extending second legs 30. The upper ends 32 of second legs 30 are attached to the rearward ends 26 of legs 20. Gussets 34 are provided to reinforce this connection. A cross member 35 extends between, and is welded to, the junctions of legs 20, 30.

Figure 3:
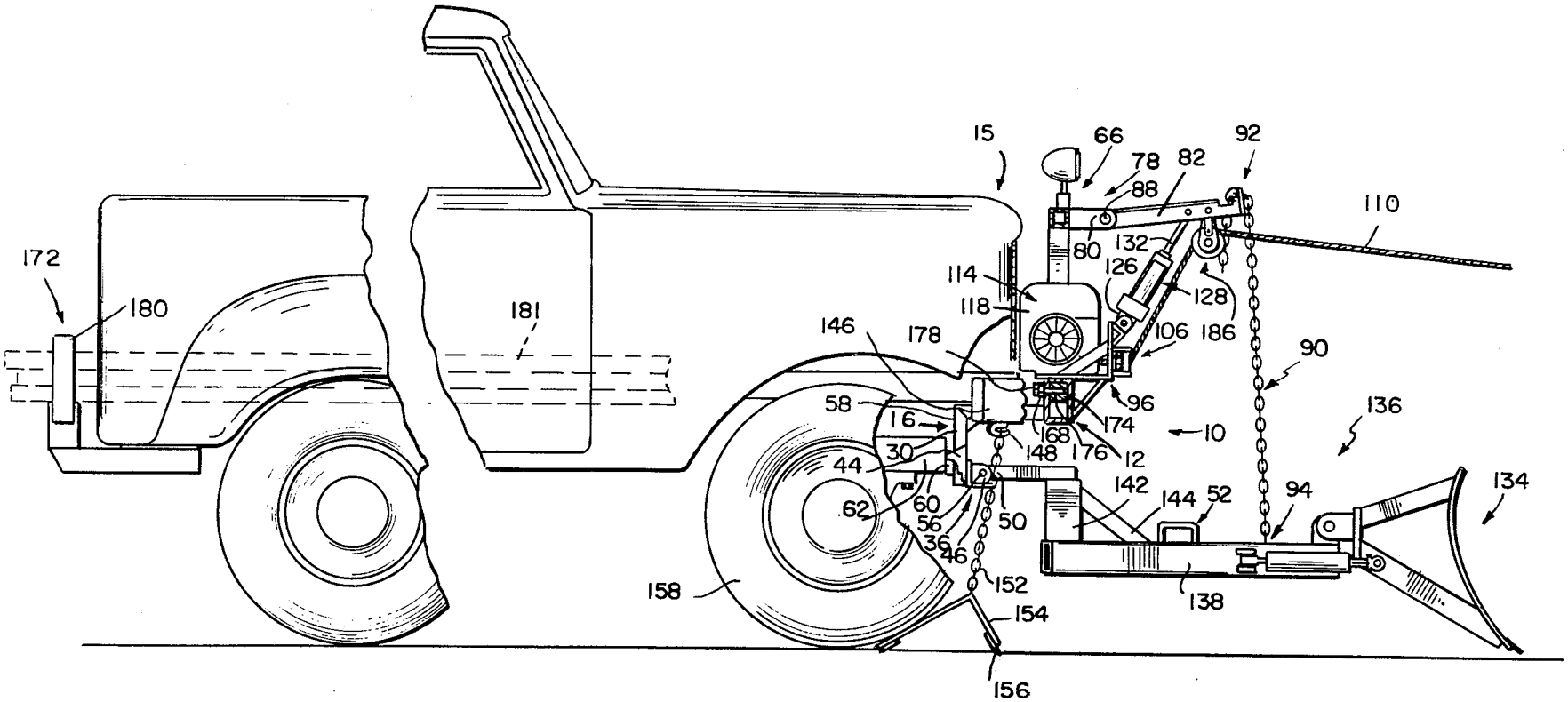
FIG. 3 is a fragmentary side elevational view of the apparatus of FIG. 1, with a power winch and a snow blade assembly attached thereto, mounted on a vehicle.

Movable mounting means 36 is provided at the lower ends 38 of second legs 30. The means 36 includes a transversely extending angle iron 40 which is attached, e.g., by welding, to lower ends 38. Fillets 42, 44 are provided to strengthen the connection of the angle iron 40 to the lower ends 38. Two spaced hinge knuckles 46 are provided adjacent each of the ends 48 of angle iron 40. As best illustrated in FIG. 4*a*, knuckles 46 are spaced apart a sufficient distance pivotally to receive the rearwardly extending hinge knuckles 50 of a snow-removal blade-supporting A-frame 52. Mating passageways are provided in the knuckles 46, 50 for hinge pins 56 (FIG. 3). As best illustrated in FIGS. 1, 3, the rearward surface 58 of each of legs 30 is provided with a spacer block 60. When snow, etc., is being pushed by the vehicle, there is substantial rearward force exerted on the lower ends 38 of legs 30. Spacer blocks 60 rest against components 62 of the vehicle undercarriage and frame to prevent this force from damaging the mounting 10.

Means 66 extends upwardly from an upper surface 68 of member 12. Means 66 includes two upstanding end legs 70, 72 welded to surface 68, and supporting a cross member 74 between their upper ends. Auxiliary lamp mounting brackets 76 are provided at the junctions of legs 70, 72 and cross member 74. The legs 70, 72 and cross member 74 form with member 12 a trapezoidal framework which, as best illustrated in FIG. 4*a*, provides a combination vehicle front end and grill guard, winch guard, and auxiliary lamp mounting.

Means 78 includes a forwardly extending lift arm stationary portion terminating at spaced hinge knuckles 80. A movable lift arm portion 82 (FIGS. 3–4*a, b*) is provided with a hinge knuckle 84 for insertion between the hinge knuckles 80. Cooperating passageways provided in hinge knuckles 80, 84 receive a hinge pin 88. A chain 90 extends between the forward end 92 of lift arm portion 82 and an attachment point 94 on A-frame 52.

Member 12 includes a winch mounting bracket 96 including a bottom plate 98 attached to surface 68 and an upwardly extending front plate 100. Reinforcing straps 102 (FIG. 1) extend between the plates 98, 100. Plate 100 is provided with a rectangular opening 104. A roller fairlead 106 is mounted on the front 108 of plate 100. As best illustrated in FIGS. 3, 4*a*, the winch cable or rope 110 extends through the fairlead 106. Mounting holes 112 for the winch 114 are provided in bracket 96. The winch 114 includes winch drum 116, upon which the cable 110 is wound, a transmission 118 and drive motor 120. Any suitable type of winch may be used. The illustrated winch is a Warn 8,000 pound, 12 volt winch available through Warn Industries, 19450 68th Avenue South, Kent, Wash. 98031.

As illustrated in FIGS. 2 and 4*a*, an angle iron 122 is attached to the front 108 of plate 100 at a vertically upper edge thereof. Two upstanding hinge knuckles 124 are provided on the iron 122. A cylinder mounting knuckle 126 (FIG. 3) of a piston and cylinder 128 is attached to knuckles 124 by a hinge pin 130. The piston rod 132 of piston and cylinder 128 is pivotally attached to lift arm 82. Actuation of the piston and cylinder 128 moves lift arm 82 upward and downward to lift and lower, respectively, the A-frame 52 supporting a snow blade 134.

The snow blade 134 and A-frame 52 comprise a snow blade assembly 136. Assembly 136 may be of several types, the one illustrated being a Meyer Snow Plows assembly available through Meyer Products, Inc., 18513 Euclid Avenue, Cleveland, Ohio 44112. However, the assembly 136 has been modified according to the present invention. Specifically, the A-frame 52 horizontal arms 138 have been sectioned. The hinge knuckles 50 on arms 138 have been removed from the arms and welded to the top of a tubular, vertically elongated riser 142. The remaining portions of the horizontal arms 138 are welded to the bottom of riser 142, giving the riser a somewhat L- or Z-shaped side elevation (FIGS. 3, 4*a*). Reinforcing braces 144 are provided between the side walls of riser 142 and the arms 138. It will be immediately appreciated that the interposition of the riser 142 between the hinge knuckles 50 and the remaining portions of arms 138 permits the legs 30 of bracket assemblies 18 (FIGS. 1, 2) to be shorter, thereby avoiding adversely affecting clearance between the vehicle undercarriage 62 and ground beneath the vehicle when the snow blade assembly 136 is removed from the vehicle, e.g., during the summer months.

Further as illustrated in FIGS. 1–3, the member 12 includes tubular rearwardly and outwardly extending vehicle side protectors 146. These side protectors 146 extend outwardly around the front portions of the vehicle fenders. With particular reference to FIG. 3, a forwardly opening chock hook 148 is welded to the underside 150 of each side protector 146. The hook 148 openings are sized to receive the links of chains 152. Chocks 154 having downwardly and forwardly projecting teeth 156 are attached to the ends of chains 152. This feature permits positive chocking of the front wheels 158 of the vehicle as required during use of the winch 114.

Suitable tow hooks 160 are provided on the upper surface 68 of elongated member 12 outside the protective framework 66.

Each end 162 of elongated member 12 is provided with a socket 164. The rearward wall 24 of elongated member 12 is provided with a passageway into the socket 164 adjacent each end, and a nut 168 (FIGS. 1, 3) is welded to the rearward wall 24 over the passageway. Referring particularly to FIGS. 3, 4*a, b*, accessories 170, 172 are provided with tongues 174 sized for slidable insertion into the sockets 164. Each tongue 174 includes a threaded passageway 176 which is in alignment with the threaded opening in its respective nut 168 when the tongues 174 are inserted into the sockets 164. Bolts 178 are threadable into the nuts 168 and passageways 176 to capture the accessories 170, 172 on the ends 162 of member 12.

Accessory 170 is a generally L-shaped corner protector for the vehicle. Accessory 172 is a generally somewhat U-shaped side carrier bracket having upstanding legs 180. Side carrier bracket 172 cooperates with a similar bracket either selectively or permanently mounted on the side of the vehicle, or the vehicle rear bumper (FIGS. 3, 4*b*) for carrying long material and equipment, e.g., ladders, metal tubing 181 (illustrated in broken lines in FIGS. 3, 4*b*), rod or bar stock, strips of lumber, etc.

The interior of member 12 is hollow, and is sealed adjacent its ends 162 by bulkheads 182 (one of which is illustrated in FIG. 1) to provide a tank capable of storing fluids under pressure. A valve 183 and quick-disconnect coupler fitting 184 are provided in the upper surface 68 of elongated member 12 to permit the interior of member 12 to be filled with, e.g., compressed air. Fitting 184 is a standard coupler to which a compressed air line can be attached to withdraw compressed air from the tank. This is useful, for example, to repair flat tires where access to other compressed air sources does not exist.

As illustrating in FIG. 3, the winch cable 110 may be threaded onto a snatch block 186 provided on movable arm portion 82. Snatch block 186 is useful to provide additional vertical clearance between the winch cable 110 and the vertically upper edge of the blade 134 in either the use ("down") or storage ("up") position.

What is claimed is:

1. A combination for mounting a winch and a snow blade assembly from a vehicle, comprising first means for supporting the winch, means for mounting the first means to extend across the front of the vehicle body, second means extending downwardly and rearwardly from the first means beneath the vehicle body, third means for movably mounting a snow blade assembly the third means being provided at the distal end of the second means, fourth means for providing a lift arm for the snow blade assembly, the fourth means projecting outwardly from the front of the vehicle body, the snow blade assembly including support frame means movably mounted from the third means for selectively movably supporting the snow blade.

2. The apparatus of claim 1 wherein the first means includes an elongated member formed to provide a front bumper for the vehicle.

3. The apparatus of claim 2 wherein the elongated member is formed to provide a tube having ends closed to provide storage for a fluid medium in the first member, and means are provided for access to the hollow tube for entry and removal of the fluid from the tube.

4. The apparatus of claim 1 wherein the second means is generally L-shaped to provide a first leg projecting rearwardly beneath the vehicle front end and a second leg projecting generally downwardly beneath the vehicle undercarriage, at the distal end of the first leg.

5. The apparatus of claim 1 wherein said fourth means includes a lift arm portion relatively stationary with respect to said first means and a lift arm portion relatively movable with respect to said first means, said relatively movable portion pivotally mounted on the relatively stationary portion above the first means and extending forwardly therefrom, and means for connecting the relatively movable portion to the snow blade assembly.

6. The apparatus of claim 5 and further comprising hydraulic piston and cylinder means connected to the relatively movable portion and to the first means, actuation of the piston and cylinder pivoting the snow blade assembly upon the third means.

7. The apparatus of claim 1 wherein the first means includes a winch mounting bracket.

8. The apparatus of claim 7 wherein the winch mounting bracket includes means providing a roller fairlead for a winch cable.

9. The apparatus of claim 1 wherein the first means includes a generally quadrilateral framework providing a combination vehicle body front end guard, winch guard, and auxiliary lamp mounting.

10. The apparatus of claim 1 wherein the first means further includes a tow hook.

11. The apparatus of claim 1 wherein the first means further includes an attachment point, the combination further including a wheel chock and means removably connecting the chock to the attachment point.

12. The apparatus of claim 1 wherein the first means includes opposite ends and means defining at one of the opposite ends a socket for receiving a tongue of an accessory and means for locking the tongue into the socket.

13. The apparatus of claim 12 in which the locking means includes a threaded passageway in one of the first means ends and a mating threaded passageway in the tongue and a threaded shaft for insertion into the passageways.

14. The apparatus of claim 12 wherein the accessory comprises a generally L-shaped vehicle corner protector.

15. The apparatus of claim 12 wherein the accessory comprises a side-carrier for carrying cargo supported outwardly from the side of the vehicle.

16. A combination for mounting a winch and snow blade assembly from a vehicle, comprising an elongated first member including a mounting bracket for supporting the winch, means for mounting the elongated first member to extend generally transversely across the front of the vehicle body to provide a front bumper, a generally L-shaped framework providing a first leg projecting rearwardly beneath the vehicle front end and a second leg projecting generally downwardly beneath the vehicle undercarriage, at the distal end of first leg, third movable mounting means provided at the distal end of the second means for a snow blade assembly, a lift arm for the snow blade, the lift arm including a portion pivotally mounted with respect to the elongated member and extending forwardly from the vehicle and means for connecting the movable lift arm portion to the snow blade assembly, the snow blade assembly including support arm means movably mounted from the third means for selectively movably supporting the snow blade.

17. The combination of claim 16 wherein the support frame means comprises arm means supporting the blade forwardly of the vehicle, the arm means extending rearwardly under the vehicle, riser means fixed to the arm means, and means for selectively pivotally mounting the riser means from the third means, the riser means improving vertical clearance between the third means and the ground beneath the vehicle when support frame means is removed from the vehicle.

* * * * *